United States Patent [19]

Navarro et al.

[11] Patent Number: 4,754,954

[45] Date of Patent: Jul. 5, 1988

[54] REFRACTORY DEVICE FOR INTRODUCING A GAS INTO A MOLTEN METAL AND A METHOD FOR MAKING THE DEVICE

[76] Inventors: Arturo Lazcano Navarro, Blvd. Harold R. Pape KM 10.67, Monclova, Coah.; Gregorio Vargas Gutierrez, Jose Clemente Orozco #480, Fracc. San Isidro, Saltillo, Coah., both of Mexico

[21] Appl. No.: 16,833

[22] Filed: Feb. 20, 1987

Related U.S. Application Data

[63] Continuation-in-part of Ser. No. 823,638, Jan. 29, 1986, abandoned.

[51] Int. Cl.[4] ..... C21C 5/48

[52] U.S. Cl. ..... 266/220; 29/157 C; 266/270

[58] Field of Search ..... 266/217, 220, 265, 270; 29/157 R, 157 C

[56] References Cited

U.S. PATENT DOCUMENTS

| | | | |
|---|---|---|---|
| 4,340,208 | 7/1982 | Vayssiere et al. | 266/220 |
| 4,378,106 | 3/1983 | Hirschberg et al. | 266/220 |
| 4,395,026 | 7/1983 | Hödl et al. | 266/220 |

FOREIGN PATENT DOCUMENTS 1271201 7/1961 France .

*Primary Examiner*—L. Dewayne Rutledge
*Assistant Examiner*—Robert L. McDowell
*Attorney, Agent, or Firm*—Laurence R. Brown; Alfred J. Mangels

[57] ABSTRACT

A device for bubbling gases through molten metal and specially adapted to be used in ladles or metallurgical vessels where it is necessary to stop the flow of gas without risk of penetration of liquid metal through the device. The device includes a metal casing holding a number of refractory plates or concentric cylinders that have opposed, specially roughened surfaces and that have their roughened surfaces juxtaposed without inserts or slots between them. The plates or cylinders can be roughened by controlled shot blasting to provide a plurality of randomly arranged surface discontinuities that define a plurality of unoriented flow passages when the plates or cylinders are placed in contacting, face-to-face relationship. Gas flow rates substantially greater than 5 liters per second can be obtained, and the device prevents molten metal flow therethrough when the gas flow has been cut off.

11 Claims, 2 Drawing Sheets

REFRACTORY DEVICE FOR INTRODUCING A GAS INTO A MOLTEN METAL AND A METHOD FOR MAKING THE DEVICE

CROSS-REFERENCE TO RELATED APPLICATION

This application is a continuation-in-part of copending application Ser. No. 823,638, filed Jan. 29, 1986 now abandoned.

BACKGROUND OF THE INVENTION

In the liquid refining of metals, gas injection is frequently used in order to eliminate impurities, to chemically and thermally homogenize the melt, and to degas and to speed up chemical reactions.

There are principally two means to introduce gases into molten metal through a refractory piece: porous plugs and gas permeable devices provided with slotted refractory plates or with inserts between them. Porous plugs have the ability to introduce small bubbles into the metal in order to improve the gas-metal mass transfer, due to the increased contact area therebetween. Another characteristic of porous plugs is their capacity to avoid metal penetration therebetween when the gas flow is cut off. The main disadvantages of porous plugs are their rapid wear with respect to the surrounding bottom lining and their limited flow capacity.

With gas permeable elements provided with refractory plates having slots or inserts between them (see U.S. Pat. Nos. 4,340,208 and 4,395,026), both the flow capacity and the wear performance have been increased, but with these devices, one cannot introduce small bubbles, and one cannot stop the flow of gas without the risk of metal infiltration between the refractory plates. Such metal penetration is critical in the ladles used for metal treatments because the flow of gas is frequently stopped when liquid metal is in the ladle.

On the other hand, Vayssiere et al. in U.S. Pat. No. 4,340,208 state that the permeability obtained by simply joining the elements together ranges from 4 to 5 liters/-second. However, in steelmaking operations such as deep desulphurization or decarburization in large metallurgical vessels, this flow rate is not enough. For example, in order to desulphurize 100 metric tons of steel from 0.03% to 0.003% of sulphur, it is necessary to bubble about 30 liters/second through the molten steel with an appropriate slag.

An object of the present invention is to provide a refractory, gas permeable device which is capable of introducing small bubbles into liquid metals with a wear performance as high as the surrounding lining, without the risk of metal penetration when the gas flow is cut off, and with a wide range of permeability.

SUMMARY OF THE INVENTION

The present invention is characterized by an embodiment which is made of an assembly of several refractory ceramic elements of high density, in order to improve its wear and chemical attack resistance. These ceramic elements can be rectangular, trapezoidal or cylindrical in shape and are made without slots or inserts between them.

In one arrangement of the invention, a number of rectangular plates are assembled in a metal casing with their large rectangular surfaces juxtaposed in face-to-back relationship. The gas flows through the spaces or surface discontinuities between the ceramic plates, which are specially roughened on their faces. Furthermore, the roughness is not oriented like slots or grooves. The spaces between adjacent ceramic plates are small enough to avoid metal infiltration when the gas flow is cut off. The spaces or surface discontinuities can be previously made by controlled shot blasting, and the like, and it is possible to obtain a wide range of space or surface discontinuities, in quantity as well as in size, required for the desired permeability.

In another arrangement, a solid cylinder without a hole is placed inside a hollow cylinder whose inner diameter is equal to the outer diameter of the solid cylinder. This assembly is placed inside another hollow cylinder, and so on.

The permeability of the device depends on the number of elements and the roughness of the surfaces of the ceramic plates. Typically with this device, the gas flow ranges between 5–800 normal lts per minute for a cross section of 100 $cm^2$.

Furthermore, in order to increase the wear performance at high temperatures, high purity oxides, like MgO, $ZrO_2$ or $Al_2O_3$, can be directly bonded to the refractory ceramic material.

DESCRIPTION OF THE PREFERRED EMBODIMENTS

Figure 1:
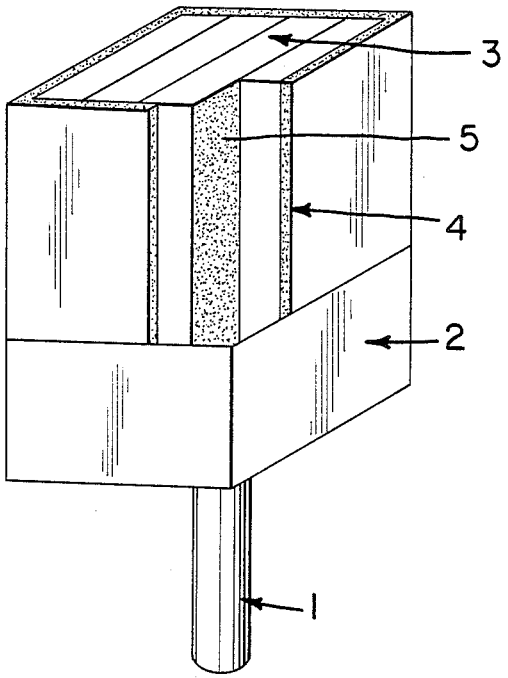
FIG. 1, is a perspective view, partially broken away, of a permeable element with rectangular plates in accordance with the present invention.
Figure 2:
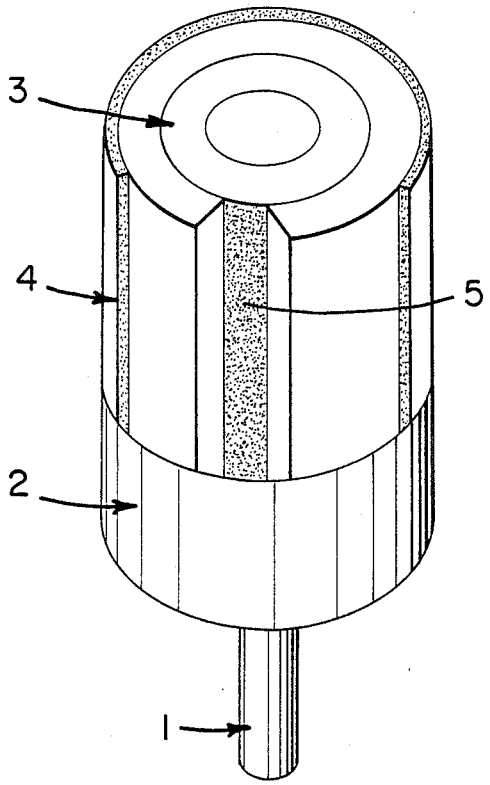
FIG. 2, is a view similar to that of FIG. 1 but of a permeable element having cylindrical parts, according to another embodiment of the present invention.

Referrring to the drawings, and particularly to FIGS. 1 and 2, a gas is introduced through the bottom admission pipe 1 and is channeled by a metal casing 2, which holds together the ceramic elements 3. The gas flows between the ceramic elements, which are provided with especially roughened surfaces. The spaces formed between adjacent roughened ceramic elements 3 are defined by small, surface indentations 5, that are small enough to permit the passage of gas to form little bubbles in the molten metal, and the ceramic elements are made without slots or inserts between them. The inventors have determined from their experience that with a certain roughness of the ceramic elements 3, the flow of gas through a 100 $cm^2$ cross section of a device formed of five face-to-back ceramic plates can range from 5–800 normal lts per minute. Furthermore, with that embodiment, the flow of gas can be stopped without risk of liquid penetration between the ceramic elements.

The surface roughness of the ceramic elements is preferably performed by controlled shot blasting. By controlling shot blasting parameters, such as the nature and size of the shot, the gas flow rate, the exposure time of the plates to shot blasting, etc., it is possible to obtain a wide range of surface discontinuities, in quantity as well as in size, required for the desired permeability. For example, it is possible to make a device of five plates, each measuring 10 cm by 50 cm on their main faces, to permit a gas flow rate as high as 90 liters/-second and a back pressure of 7 $kg/cm^2$ without risk of liquid metal infiltration through the permeable element when the gas flow is cut off.

In order to obtain an optimal channelization of the gas through the permeable element, an outer peripheral layer defined by a compacted refractory outer liner 4 surrounds the assembly of ceramic plates.

The method of making the device includes the steps of cutting a non-porous refractory brick longitudinally in the direction of its height into several elements or, alternatively, pressing a high density refractory material into predetermined size molded elements, controlled shot blasting of at least one of the principal faces of each element in order to roughen faces of the elements that are opposite adjacent elements, and juxtaposing and holding the elements together by a metal casing 2 which includes gas admission pipe 1 to introduce the gas into the permeable assembly.

The device of the present invention can be installed in the side walls or in the bottom of any metallurgical vessel, especially where it is necessary to introduce small bubbles, or where it is necessary to stop the flow of the gas without liquid penetration through the permeable assembly.

Through this permeable ceramic device, it is possible to inject mixtures of gases, either oxidizing, reducing or inert types, or a mixture thereof, resulting in a minimum of wear. Moreover, when high purity oxides like MgO, ZrO and $Al_2O_3$ are directly bonded to the surfaces of the ceramic elements, the wear performance is increased considerably.

What is claimed is:

1. A method for producing a refractory device for introducing gas into a molten metal, the device including an assembly of high density refractory elements having roughened surfaces, said method comprising the steps of: providing a plurality of non-porous refractory brick elements to form part of a refractory lining of a metallurgical vessel, the elements each having principal faces; controlled shot blasting of the principal faces of the elements in order to provide a roughened surface to define a plurality of randomly arranged surface discontinuities; juxtaposing the principal faces of the elements in contacting face-to-face relationship so that the randomly arranged surface discontinuities define a plurality of unoriented flow passages therebetween, wherein the flow passages permit gas flow rates substantially greater than 5 liters per second through the device; and holding the juxtaposed principal faces of the elements together by a metallic case which is provided with a gas admission pipe to permit gas to flow through the device but to prevent molten metal from flowing therethrough when the gas flow is cut off.

2. A method as defined in claim 1, wherein the refractory elements are made by pressing high density refractory material into predetermined size molds.

3. A method as defined in claim 1 wherein the refractory elements are made by cutting non-porous refractory brick longitudinally in the direction of its height into several elements.

4. An apparatus for introducing gas into molten metal in the form of small bubbles, said apparatus comprising: a casing; a plurality of high density refractory elements within the casing and having their major surfaces in abutting adjacent contact with one another along their major axes, said refractory elements having roughened surfaces over their adjacent contacting surfaces to define a plurality of unoriented flow passages between abutting elements, wherein the flow passages permit gas flow rates substantially greater than 5 liters per second through the casing, the surface roughness being sufficient to permit gas flow between the abutting elements and to avoid molten metal penetration between the refractory elements when the gas flow is cut off.

5. An apparatus as claimed in claim 4 wherein the refractory elements are rectangular in cross section.

6. An apparatus as claimed in claim 4 wherein said refractory elements are circular in cross section and one cylinder without a hole is placed inside one hollow cylinder whose inner diameter is equal to the outer diameter of said one cylinder, said cylinders being concentrically mounted one within the other to define an assembly of refractory elements.

7. An appartus for introducing gas into molten metal in the form of small bubbles, said apparatus comprising: a casing; a plurality of high density refractory elements within the casing and having their major surfaces in abutting adjacent contact with one another along their major axes, said refractory elements having roughened surfaces over their adjacent contacting surfaces, the surface roughness being sufficient to permit gas flow between the abutting elements and to avoid molten metal penetration between the refractory elements should gas flow be cut off, wherein the refractory elements are made by a method that includes the steps of: providing a plurality of non-porous refractory brick elements to form part of a refractory lining of the casing, the elements each having principal faces; controlled shot blasting of the principal faces of the elements in order to provide a roughened surface to define a plurality of randomly arranged surface discontinuities; juxtaposing the principal faces of the elements in contacting face-to-face relationship so that the randomly arranged surface discontinuities define a plurality of unoriented flow passages therebetween, wherein the flow passages permit gas flow rates substantially greater than 5 liters per second through the casing; and holding the juxtaposed principal faces of the elements together by the casing, which is provided with a gas admission pipe to permit gas to flow through the casing but to prevent molten metal from flowing therethrough when the gas flow is cut off.

8. An apparatus as claimed in claim 7 wherein the refractory elements are rectangular in cross section.

9. An apparatus as claimed in claim 7 wherein said refractory elements are circular in cross section and one cylinder without a hole is placed inside one hollow cylinder whose inner diameter is equal to the outer diameter of said one cylinder, said cylinder being concentrically mounted one within the other to define an assembly of refractory elements.

10. A method as defined in claim 1, wherein the flow passages permit gas flow rates of at least about 30 liters per second through the device.

11. An apparatus as claimed in claim 4, wherein the flow passages permit gas flow rates of at least about 30 liters per second through the casing.

* * * * *